US008168016B1

(12) United States Patent
Nicolich et al.

(10) Patent No.: US 8,168,016 B1
(45) Date of Patent: May 1, 2012

(54) HIGH-BLAST EXPLOSIVE COMPOSITIONS CONTAINING PARTICULATE METAL

(75) Inventors: Steven M. Nicolich, Wyckoff, NJ (US); Christos Capellos, Morris Plains, NJ (US); Wendy A. Balas, Green Brook, NJ (US); Jeffrey D. Akester, Bountiful, UT (US); Robert L. Hatch, Wellsville, UT (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 1309 days.

(21) Appl. No.: 10/907,599

(22) Filed: Apr. 7, 2005

Related U.S. Application Data

(60) Provisional application No. 60/521,350, filed on Apr. 7, 2004.

(51) Int. Cl.
*D03D 23/00* (2006.01)
*D03D 43/00* (2006.01)

(52) U.S. Cl. ..... 149/109.6; 149/108.2; 149/109.4

(58) Field of Classification Search ..... 149/109.6, 149/108.2, 109.4
See application file for complete search history.

(56) References Cited

U.S. PATENT DOCUMENTS

| | | | | |
|---|---|---|---|---|
| 2,589,532 | A * | 3/1952 | Byers | 149/39 |
| 3,745,927 | A * | 7/1973 | Tanner et al. | 102/531 |
| 5,009,728 | A * | 4/1991 | Chan et al. | 149/19.1 |
| 5,472,531 | A * | 12/1995 | Turci et al. | 149/92 |
| 5,567,912 | A | 10/1996 | Manning | |
| 6,214,137 | B1 * | 4/2001 | Lee et al. | 149/19.7 |
| 6,689,470 | B1 * | 2/2004 | Joseph | 428/408 |
| 7,360,508 | B2 * | 4/2008 | Habib et al. | 122/379 |
| 2002/0144759 | A1 * | 10/2002 | Walsh | 149/19.7 |

OTHER PUBLICATIONS

U.S. Appl. No. 10/756,192, filed Jan. 13, 2004, Akester, Jeff.
Akester, Jeff; Braithwaite Paul; Nicolich, Steve, Influence of Submicron Particles on the Properties of Energetic Formulations,2004, 8pgs, Thiokol Inc., USA.
Schaefer, Ruth A; Nicolich Steve M.; Development and Evaluation of New High Blast Explosives, 2004, 9 pgs, Thiokol, Inc., USA.
Fuchs, Brian Edward; Picatinny Arsenal Cylinder Expansion Test and a Mathematical Examinatio of the Explanding Cylinder, Oct. 1995, 30 pages, US Army ARDEC, Picatinny, NJ, USA.

* cited by examiner

*Primary Examiner* — James McDonough
(74) *Attorney, Agent, or Firm* — Henry S. Goldfine

(57) ABSTRACT

High performance aluminized explosive compositions for high performance, high blast, low sensitivity explosive applications are disclosed. The compositions include Cl-20, HMX, RDX, or another material as the explosive ingredient, a binder system of cellulose acetate butyrate and bis-dinitropropyl acetyl and bis-dinitropropyl formal, and aluminum. The explosive is preferably pressable and or/mixable to permit formation into grains suitable for ordnance and similar applications including grenades, warheads, landmines, demolition, etc. The aluminum fully participates in the detonation of said explosive, manifesting its energy into fully useable metal pushing energy suitable for shaped charges, explosively formed penetrators, fragmentation warheads, enhanced blast warheads, multipurpose warheads, and the like. The aluminum is substantially reacted at two volume expansions of the expanding gas, and fully reacted prior to seven volume expansions of the expanding gas.

6 Claims, No Drawings

HIGH-BLAST EXPLOSIVE COMPOSITIONS CONTAINING PARTICULATE METAL

CROSS REFERENCE TO RELATED APPLICATIONS

This Application claims benefit under 35 USC 199(e) of Provisional Application No. 60/521,350, filed Apr. 7, 2004, the entire file wrapper contents of which provisional application are herein incorporated by reference as though fully set forth at length.

FEDERAL INTEREST STATEMENT

The invention described herein may be made, used, or licensed by or for the United States Government for Government purposes without the payment of any royalties thereon or therefore.

BACKGROUND OF THE INVENTION

1. Field of the Invention

The present invention relates to high-blast explosive compositions containing a particulate metal. In particular, the present invention relates to explosives containing a metal, such as aluminum, wherein the metal fully participates in the detonation of said explosive fully manifesting the energy into fully useable metal pushing energy suitable for shaped charges, explosively formed penetrators, fragmentation warheads, enhanced blast warheads, multipurpose warheads, and the like.

2. Description of Related Art

Explosive molding powders are known in the art and are used in various types of ordnance, such as grenades, land mines, missile warheads, and demolition explosives. The explosive molding powder is castable, extrudable or pressable into a desired shape for use in the ordnance. Typically, metals such as Al, Mg, B, are added to the explosive to increase blast energy and total energy.

One problem with adding aluminum or other metals to explosive molding powders is that, although total energy increases, most of the energy derived from the added metal is typically wasted as thermal energy. Relative to the time domain of the energy released from the typical energetic filler, such as a nitramine like RDX, HMX, CL-20, or other organic energetic compounds such as PETN, TATB, etc., the energy from the metal is released later. Therefore, addition of aluminum or other metals is not practical for applications requiring very high metal pushing/acceleration performance such as, a shaped charge, explosively formed penetrator, or high performing fragmentation warhead.

Recently, there has been interest in understanding the role of fine (less than 10 microns) and ultra fine (nanometric) aluminum and other metals in high explosives. It has been theorized by many that very fine particles of aluminum, mainly nanometric aluminum, or other metals may react in the relevant time domain of the detonation reaction and contribute substantially to the metal pushing performance property of the explosive. However, although under investigation by the energetic materials community, this effect has not been reported or reduced to practice.

It is, therefore desirable to demonstrate and provide an aluminized explosive where the aluminum fully reacts in the early time of detonation and substantially contributes to the metal pushing energy of the explosive formulation. This would allow for a higher performance explosive suitable for use in shaped charge and EFP warheads, multimode warheads, multipurpose warheads, fragmentation warheads, and other applications desiring high performance and/or high blast. A warhead could be designed that takes advantage of both the extra metal pushing energy and blast energy. Furthermore, having less explosive filler in the formulation may improve impact, thermal, and shock sensitivity properties with improved performance. This would be a significant contribution since these properties are usually diametrically opposed.

BRIEF SUMMARY OF THE INVENTION

Explosive molding powders are known in the art and are used in various types of ordnance, such as grenades, land mines, missile warheads, and demolition explosives. The explosive molding powder is castable, extrudable or pressable into a desired shape for use in the ordnance. Typically, metals such as Al, Mg, B, are added to the explosive to increase blast energy and total energy.

One problem with adding aluminum or other metals to explosive molding powders is that, although total energy increases, most of the energy derived from the added metal is typically wasted as thermal energy. Relative to the time domain of the energy released from the typical energetic filler, such as a nitramine like RDX, HMX, CL-20, or other organic energetic compounds such as PETN, TATB, etc., the energy from the metal is released later. Therefore, addition of aluminum or other metals is not practical for applications requiring very high metal pushing/acceleration performance such as, a shaped charge, explosively formed penetrator, or high performing fragmentation warhead.

Recently, there has been interest in understanding the role of fine (less than 10 microns) and ultra fine (nanometric) aluminum and other metals in high explosives. It has been theorized by many that very fine particles of aluminum, mainly nanometric aluminum, or other metals may react in the relevant time domain of the detonation reaction and contribute substantially to the metal pushing performance property of the explosive. However, although under investigation by the energetic materials community, this effect has not been reported or reduced to practice.

It is, therefore desirable to demonstrate and provide an aluminized explosive where the aluminum fully reacts in the early time of detonation and substantially contributes to the metal pushing energy of the explosive formulation. This would allow for a higher performance explosive suitable for use in shaped charge and EFP warheads, multimode warheads, multipurpose warheads, fragmentation warheads, and other applications desiring high performance and/or high blast. A warhead could be designed that takes advantage of both the extra metal pushing energy and blast energy. Furthermore, having less explosive filler in the formulation may improve impact, thermal, and shock sensitivity properties with improved performance. This would be a significant contribution since these properties are usually diametrically opposed.

OBJECTS OF THE INVENTION

It is, therefore, an object of this invention to provide an explosive formulation that addresses the aforementioned problems associated with the related art and realizes the advancement expressed above.

The primary object of the invention is to provide an aluminized explosive formulation whereby the aluminum reacts in the early time of the detonation thereby contributing to the explosive formulations ability to drive metal or other materials.

In accordance with the principles of this invention, these and other objects are attained by providing an explosive formulation prepared from polymers and plasticizers combined with high performance explosives comprising CL-20, HMX and RDX, and aluminum. Generally this formulation includes about 60-80% explosive filler, 10-30% metals, and the balance being the binder system. The binder system comprises at least one binder, preferably cellulose acetate butyrate (CAB), at least one plasticizer, preferably bis-dinitropropyl acetal/bis-dinitropropyl formal (BDNPA/F). The metals comprise at least one metal, preferably aluminum. The aluminum may be micron size or nanometric size aluminum.

This invention also relates to articles comprising the above-discussed formulations. The formulation is preferably sufficiently pressable, castable, or extrudable to permit it to be formed into grains or billets, for example, suitable for ordnance and similar applications. The principles of the present invention outlined above are applicable to a variety of explosive articles, but have particular applicability to pressed or injection loaded ordnances such as grenades, land mines, missile warheads, and demolition explosives.

These and other objects, features, and advantages of the present invention will become apparent from the accompanying drawing and following detailed description which illustrate and explain, by way of example, the principles of the present invention.

The other objects, features and advantages of the present invention will become more apparent in light of the following detailed description of the preferred embodiment thereof.

SUMMARY OF THE INVENTION

According to the present invention, there is provided a high-blast explosive composition containing a particulate metal and wherein said particulate metal fully reacts in the early detonation stage prior to seven volume expansions of the explosive composition.

According to another embodiment of the present invention, there is provided a high-blast explosive composition containing a particulate metal, and wherein said particulate metal fully reacts in the early detonation stage prior to seven volume expansions of the explosive composition, and comprising:

an explosive component comprising from about sixty weight percent (60 wt. %) to about ninety-six weight percent (96 wt. %) of an explosive selected from the group consisting of: CL-20, HMX, RDX, HNS, TATB, PETN, TNT, DNAN, nitramines, nitrate esters, nitrated aromatics, melt phase explosives, and combinations thereof;

a binder system component comprising from about two weight percent (2 wt. %) to about fifteen weight percent (15 wt. %), and comprising:

a binder component comprising from about three weight percent (3 wt. %) to about six and five-tenths weight percent (6.5 wt. %), and comprising a binder selected from the group consisting of: cellulose acetate butyrate, a fluoroelastomer, ethyl vinyl acetate, a polyisobutylene polymer, nylon, a thermoplastic polyester elastomer, a polyacrylate elastomer, a thermoplastic polyurethane, a polyvinyl chloride, a polyether block amide, and combinations thereof; and, an energetic plasticizer component comprising from about three and six-tenths weight percent (3.6 wt. %) to about nine and one-half weight percent (9.5 wt. %), and comprising a plasticizer selected from the group consisting of bis-dinitropropyl acetyl and bis-dinitropropyl formal (BDNPA/F), isodecyl pelargonate (IDP), dioctyl adipate (DOA) dioctyl sebecate (DOS), a glycidyl azide polymer (GAP), and combinations thereof;

a particulate metal component comprising from about one weight percent (1 wt. %) to about forty weight percent (40 wt. %) and comprising a particulate metal selected from the group consisting of aluminum, boron, magnesium and combinations thereof;

a stabilizer component comprising from about zero weight percent (0.0 wt. %) to about one weight percent (1.0 wt. %), and comprising a stabilizer selected from the group consisting of diphenylamine, n-alkyl nitroanilines, and combinations thereof.

DETAILED DESCRIPTION OF THE INVENTION

Explosive formulations are disclosed for demonstrating reaction of micron size aluminum in the early time detonation zone of the explosive formulation thereby contributing substantially to the ability of the explosive formulation to drive metal and other materials. This particular performance parameter is widely known in the art as the Gurney Energy and generally accepted method used to obtain this particular measurement of performance is commonly referred to as the Cylinder Expansion Test.

The present invention is directed to high energy explosive formulations containing CL-20, HMX, RDX, HNS, TATB, PETN, other nitramines, nitrate esters, nitrated aromaticsor mixtures thereof. The formulation of this invention may include about 50-90% explosive filler, more preferably 64% -77% CL-20, HMX, or RDX.

The invention formulation further includes a binder system that makes the formulation less sensitive to external stimuli. The binder system may be selected from the group consisting of cellulose acetate butyrate ("CAB"), a fluoroelastomer, ethyl vinyl acetate, polyisobutylene polymer, nylon, a thermoplastic polyester elastomer, a polyacrylate elastomer, a thermoplastic polyurethane, a polyvinyl chloride, and a polyether block amide. The lacquer system may optionally comprise a plasticizer selected from the group consisting of bis-dinitropropyl acetal and bis-dinitropropyl formal ("BDNPA/F"), isodecyl pelargonate ("IDP"), dioctyl adipate ("DOA"), dioctyl sebecate ("DOS"), a glycidyl azide polymer ("GAP"), and mixtures thereof. The formulation of this invention may include about 2-15% binder system, more preferably, the binder system includes at least cellulose acetate butyrate (CAB) as a non-energetic binder and bis-dinitropropyl acetal and bis-dinitropropyl formal (BDNPA/F) as an energetic plasticizer. The ratio of bis-dinitropropyl acetal to bis-dinitropropyl formal in the BDNPA/F should be selected to provide the mixture in a liquid and substantially free flowing state. Preferably, the ratio by weight is between about 45:55 and about 55:45, and more preferably about 50:50. In accordance with the preferred embodiments, the formulation contains the CAB binder in a concentration of from about 2.4 wt % to about 6.0 wt % CAB and the BDNPA/F plasticizer in a concentration of from about 3.6 wt % to about 9.5 wt %. More preferably, the formulation includes about 3.2 wt % CAB and about 4.8 wt % BDNPA/F.

The invention formulation further includes metals or metal mixtures such as Al, B, and Mg. The metals comprise at least one metal, preferably aluminum. The aluminum may be micron size or nanometric size aluminum. The aluminum may include concentrations of 5-40%, preferably 15-20%.

Additional additives may be included in the formulation such as metal mixtures, conductive materials, processing aids, stabilizers, surfactants, antioxidants, and carbon nanotubes.

The formulations of this invention can be prepared in slurry process. The preparatory process in accordance with one embodiment is conducted using a non-aqueous slurry process since a water slurry process may not be suitable for water reactive additives. Other operations used to process these formulations may include, but are not limited to, vertical mixing, pressing, machining, and extrusion.

Another patent, recently filed, "Improved Explosive Molding Powder Slurry Processing in a Non-Aqueous System Medium Using a Mixed Solvent Lacquer System" by Akester et. al. fully describes one of the processes used to make the formulations of this invention and is incorporated herein by reference. Another patent describing a version of said formulations containing no metals are also disclosed by Lee, et. al. U.S. Pat. No. 6,214,137 "High Performance Explosive Containing CL-20" and is also incorporated herein by reference.

EXAMPLES

The following examples have been selected and are being presented to further describe the principles of this invention. These examples are not intended and should not be interpreted as exhaustive of or as a restriction on the overall scope of this invention.

Examples 1, 2, and 3 utilized procedures fully described by another patent, recently filed, "Improved Explosive Molding Powder Slurry Processing in a Non-Aqueous System Medium Using a Mixed Solvent Lacquer System" by Akester et. al. incorporated by reference herein. These formulations also have been made using other methods, such as vertical mixing. Example 4 utilized a vertical mix process but can be made using the processes to make the formulations described in examples 1, 2, and 3. These processes are given by way of example and are not intended to imply that other processes cannot be used to make such formulations. It is completely expected that other processes used to make the formulations described herein would have the same end results. For all examples, each formulation was subjected to the Cylinder Expansion Test and the Gurney Energy was derived. For each formulation made, the resulting powder obtained was then pressed to greater than 99% of the theoretical maximum density, machined into pellets measuring approximately 1" diameter by 1.0" long. The pellets were assembled into a 1" ID, 1.2" OD, by 12" long copper cylinder. 4 additional pellets were used for run up so a total of 16 pellets were used for each test. All tests were run in at least duplicate and triplicate to ensure results were reproducible. A detailed description of the cylinder expansion test can be found in US ARMY ARDEC Technical Report AD-E402 695 by B. Fuchs.

Example 1

The PAX-29 formulation consisting of 77% CL-20, 15% micron size Aluminum, 4.8% BDNPA/F and 3.2% CAB was manufactured, pressed, machined, and tested in the cylinder expansion test. The molding powders lot numbers used to prepare the pellets were RH-1803-42 and RH-1803-43. An additional set of tests were performed utilizing lot #s RH-1803-44 and RH-1803-45.

Example 2

The PAX-29n formulation consisting of 77% CL-20, 15% submicron size aluminum, 4.8% BDNPA/F and 3.2% CAB was manufactured, pressed, machined, and tested in the cylinder expansion test. The molding powders lot numbers used to prepare the pellets were JA-1878-24, JA-1878-25, and JA-1878-26.

Example 3

The PAX-30 formulation consisting of 77% HMX, 15% micron size aluminum, 4.8% BDNPA/F and 3.2% CAB was manufactured, pressed, machined, and tested in the cylinder expansion test. The molding powders lot numbers used to prepare the pellets were from lot numbers RH-1942-8, RH-1942-10, RH-1942-11, and RH-1942-14.

Example 4

The PAX-3a formulation consisting of 64% HMX, 20% micron size aluminum, 4.8% BDNPA/F and 3.2% CAB was manufactured, pressed, machined, and tested in the cylinder expansion test.

Example 5

The PAX-42 formulation consisting of 77%, 15% micron size aluminum, 4.8% BDNPA/F and 3.2% CAB was manufactured, pressed, machined, and will be tested in the cylinder expansion test. It is expected that the RDX formulation will also achieve significant energy levels compared to other RDX formulations. The calculated Gurney Constant at V/Vo=7 is 3.08.

Set forth below in Table 1 are the formulations from examples 1-4 and measured Gurney energy along with three other high performance explosives and their measured gurney energies for comparison purposes. The table also includes calculated total energy for each formulation. Set forth below in Table 2 are the percentage increase (decrease) in energy of each formulation relative to LX-14 for both metal pushing and blast energy.

TABI.E 1

| | Example 1 | Example 2 | Example 3 | Example 4 | LX-14 | PAX-12 | PAX-3 | Example 5 |
|---|---|---|---|---|---|---|---|---|
| Density (TMD) | 2.022 | 2.022 | 1.921 | 1.877 | 1.853 | 1.930 | 1.877 | 1.851 |
| Density (Measured) | 1.999 | 2.010 | 1.909 | 1.877 | 1.820 | 1.918 | 1.877 | 1.834 |
| A1 (%) | 15 Micron Size | 15 sub micron Size | 15 Micron Size | 20 Micron Size | 0 | 0 | 20 Nominal 39μ | 15 Micron Size |
| CL-20 (%) | 77 | 77 | | | 90 | | | |
| HMX (5) | | | 77 | 64 | 95.5 | | 64 | |
| RDX (%) | | | | | | | | 77 |
| BDNPA/F (%) | 4.8 | 4.8 | 4.8 | 9.5 | | 6 | 9.5 | 4.8 |

TABI.E 1-continued

| | Example 1 | Example 2 | Example 3 | Example 4 | LX-14 | PAX-12 | PAX-3 | Example 5 |
|---|---|---|---|---|---|---|---|---|
| CAB (%) | 3.2 | 3.2 | 3.2 | 6.5 | | 4 | 6.5 | 3.2 |
| Estane (%) | | | | | 4.5 | | | |
| Average Measured Gurney Constant @ V/Vo = 7 (km/sec) | 3.16 | 3.16 | 3.07 | 2.69 | 3.05 | 3.16 | 2.55 | 3.09 |
| Detonation Velocity Measured (km/s ) | 8.9 | 8.77 | 8.53 | 8.18 | 8.88 | 9.03 | 8.18 | 8.21 |
| Total Energy Calculated (KJ/cc) | 14.11 | 13.70 | 12.90 | 13.37 | 9.96 | 10.30 | 13.375 | 12.50 |

TABLE 2

| HE | Percent Change Compared to LX-14 Metal Pushing Energy/Unit Mass (Experimental) | Metal Pushing Energy/Unit Volume (Experimental) | Blast Energy/Unit Volume (Calculated) |
|---|---|---|---|
| LX14 | 0 (Baseline) | 0 (Baseline) | 0 (Baseline) |
| PAX-3 | −30 | −28 | 34 |
| PAX3a | −22 | −20 | 34 |
| PAX-12 | 7 | 13 | 3 |
| PAX29c | 7 | 18 | 42 |
| PAX-29n | 7 | 18 | 38 |
| PAX30 | 1 | 6 | 30 |
| PAX-42 | 1 | 3 | 24 |

While the invention may be susceptible to various modifications and alternative forms, specific embodiments have been shown by way of example and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What is claimed is:

1. An explosive composition consisting essentially of:

an explosive component containing seventy-seven weight percent (77 wt %) of the explosive composition, said explosive component selected from the group consisting of: CL-20, HMX, RDX, HNS, TATB, PETN, TNT, ONAN, nitramines, nitrate esters, nitrated aromatics, melt phase explosives, and combinations thereof;

a binder system component containing three and two-tenths weight percent (3.2 wt. %) of the explosive composition, said binder component selected from the group consisting of: cellulose acetate butyrate, a fluoroelastomer, ethyl vinyl acetate, a polyisobutylene polymer, a nylon, a thermoplastic polyester elastomer, a polyacrylate elastomer, a thermoplastic polyurethane, a polyvinyl chloride, a polyether block amide and combinations thereof; and an energetic plasticizer component containing four and eight-tenths weight percent (4.8 wt. %) of the explosive composition, said plasticizer component selected from the group consisting of bis-dinitropropyl acetyl and bis-dinitropropyl formal (BDNPA/F), isodecyl pelargonate (IDP), dioctyl adipate (DOA) dioctyl sebecate (DOS), a glycidyl azide polymer (GAP), and combinations thereof;

a particulate metal component containing fifteen weight percent (15 wt. %) of the explosive composition, said particulate metal component selected from the group consisting of aluminum, boron, magnesium and combinations thereof, wherein the size of all the said particulate metal component is less than ten microns (10 μm) in diameter.

2. The explosive composition of claim 1, wherein the particle size of said particulate metal component is from about two-tenths of a micron (0.2 μm) to less than ten microns (10.0 μm) in diameter.

3. The explosive composition of claim 1, wherein the particle size of said particulate metal component is from about three microns (3 μm) to about four microns (4.0 μm) in diameter.

4. For an explosive composition consisting essentially of:

an explosive component containing seventy-seven weight percent (77 wt %) of the explosive composition, said explosive component selected from the group consisting of: CL-20, HMX, RDX, HNS, TATB, PETN, TNT, ONAN, nitramines, nitrate esters, nitrated aromatics, melt phase explosives, and combinations thereof;

a binder system component containing three and two-tenths weight percent (3.2 wt. %) of the explosive composition, said binder component selected from the group consisting of: cellulose acetate butyrate, a fluoroelastomer, ethyl vinyl acetate, a polyisobutylene polymer, a nylon, a thermoplastic polyester elastomer, a polyacrylate elastomer, a thermoplastic polyurethane, a polyvinyl chloride, a polyether block amide and combinations thereof; and an energetic plasticizer component containing four and eight-tenths weight percent (4.8 wt. %) of the explosive composition, said plasticizer component selected from the group consisting of bis-dinitropropyl acetyl and bis-dinitropropyl formal (BDNPA/F), isodecyl pelargonate (IDP), dioctyl adipate (DOA) dioctyl sebecate (DOS), a glycidyl azide polymer (GAP), and combinations thereof;

a particulate metal component containing fifteen weight percent (15 wt. %) of the explosive composition, said particulate metal selected from the group consisting of aluminum, boron, magnesium and combinations thereof, wherein the size of all said particulate metal is less than ten microns (10 μm) in diameter;

a method of preparing and using the explosive composition comprising the steps of:

combining the explosive component, the binder system component, the energetic plasticizer component and the particulate metal component together until the explosive composition is formed; and detonating the formed explosive composition.

5. The method of claim 4, wherein the particle size of said particulate metal is from about two-tenths of a micron (0.2 μm) to less than ten microns (10.0 μm) in diameter.

6. The method of claim 4, wherein the particle size of said particulate metal from about three microns (3 μm) to about four microns (4.0 μm) in diameter.

* * * * *